US006982391B2

(12) United States Patent
Da Dalt

(10) Patent No.: US 6,982,391 B2
(45) Date of Patent: Jan. 3, 2006

(54) SAFETY POSITION SWITCH

(75) Inventor: Hugues Da Dalt, Champniers (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 10/989,329

(22) Filed: Nov. 17, 2004

(65) Prior Publication Data

US 2005/0109593 A1 May 26, 2005

(30) Foreign Application Priority Data

Nov. 21, 2003 (FR) ..... 03 13651

(51) Int. Cl.
*H01H 27/00* (2006.01)

(52) U.S. Cl. ..... 200/43.04; 200/43.07; 200/61.62; 200/334

(58) Field of Classification Search ..... 200/43.04, 200/43.07, 61.62, 334
See application file for complete search history.

(56) References Cited

U.S. PATENT DOCUMENTS 5,488,207 A * 1/1996 Niwa et al. ..... 200/43.04
5,584,378 A * 12/1996 Wecke et al. ..... 200/43.04
5,777,284 A * 7/1998 Mohtasham ..... 200/43.04
5,868,243 A * 2/1999 Bachle ..... 200/334
5,964,342 A * 10/1999 Wecke et al. ..... 200/534
6,037,551 A * 3/2000 Fukui et al. ..... 200/43.04
6,872,898 B2 * 3/2005 Mohtasham ..... 200/43.01

FOREIGN PATENT DOCUMENTS

EP 0 801 801 B1 6/1998

* cited by examiner

*Primary Examiner*—Michael A. Friedhofer
(74) *Attorney, Agent, or Firm*—Oblon, Spivak, McClelland, Maier & Neustadt, P.C.

(57) ABSTRACT

A safety position switch including a push rod which responds to the movement of an actuator connected to a device to be made safe in order to act upon an electrical device by a lockable transmission mechanism acted on by the push rod. The transmission mechanism includes a pivoting lever capable of assuming a locked position and an unlocked position. The pivoting lever has force applied to it from the push rod such that a movement of translation of the push rod generates a rotation of the lever and the pivoting lever has an arm with a jamming element that is applicable, in the locked position of the lever and transversely with respect to the main axis, against the locking head.

15 Claims, 4 Drawing Sheets

SAFETY POSITION SWITCH

BACKGROUND OF THE INVENTION

1. Field of the Invention

The present invention relates to a safety position switch of the type comprising a push rod which responds to the movement of an actuator connected to a device to be made safe, in such a way as to become displaced along a main axis in order to assume a rest position and a working position, comprising an electrical device, in particular a contacts block, switchable according to the position of the push rod, by means of a lockable transmission mechanism actuated by the push rod, and comprising a device for locking the transmission mechanism, which has a head for locking the mechanism, the locking head being capable of assuming a locked position and an unlocked position.

2. Description of the Related Art

In order to simplify the description, the expression "safety position switch" will hereafter be replaced by the expression "safety switch".

Safety switches of the type described above are known for example from the document EP 817 227. These switches are associated with devices to be made safe, such as dangerous machines.

The locking device of the transmission mechanism is frequently produced in the form of an electromagnet disposed laterally with respect to the actuating head/push rod/contacts block assembly. It can also be a manually controlled device, for example by a key, or a pneumatic device or any other similar driving device.

Other safety switches have an elongated arrangement, or are of the "vertical" type, such that the locking electromagnet is located in the axis of the push rod and of the contacts block to be actuated (see for example EP 801 801). This configuration is advantageous for responding to certain size prescriptions of switches. However, the switches of this type do not sufficiently disassociate the movement of the locking device with respect to that of the push rod.

SUMMARY OF THE INVENTION

It is desirable to produce a safety switch having a reliable lockable drive mechanism and which is of small size but nevertheless allowing certain freedoms of implementation, such as a rotation of the operating head, without changing the state of certain components of the switch. Furthermore, it is desirable to correctly retain the inherent safety function of the switch when extraction forces are applied on the actuator and, if necessary, to be able to unlock the switch whilst the actuator is under load.

The purpose of the invention is to respond to these desiderata.

According to the invention, the transmission mechanism comprises a pivoting lever capable of assuming a locked position and an unlocked position; the pivoting lever has force applied to it from the push rod such that a movement of translation of the push rod generates a rotation of the lever, and the pivoting lever is provided with a jamming element that is applicable, in the locked position of the lever and transversely with respect to the main axis, against the locking head.

The mechanism thus described makes it possible to jam the locking head by a mechanism of small size, with a jamming force that is easy to predetermine. It also makes it possible to unlock the safety switch whilst the actuator is under load. This means that, whilst the actuator is subjected to a considerable force of extraction from the head of the switch, the locking device, in particular the electromagnet, can nevertheless be switched from its locking state to its unlocking state. It is also possible to define the transmission mechanism as comprising a jamming system that is deformable under the effect of the movement of the push rod, this system being provided with a stop for the locking head in the direction of the main axis and with a jamming element applying on the locking head a force that is transverse with respect to the main axis when the actuator tends to be withdrawn from the switch casing.

It is advantageous for the lever to be mounted such that it pivots about an axis perpendicular to the main axis and that it is arranged such that the force applied to the locking head is low in comparison with the force undergone by the actuator, in a ratio allowing a movement of the locking head whilst the actuator is under load and following a control to unlock the locking device.

The locking head can move in translation along the main axis and the pivoting lever can form a stop keeper for the end of the locking head in the locked position and a bearing slope adjacent to the keeper, the end of the locking head then being applied, in particular under the effect of a spring, against the slope in the unlocked position.

The transmission mechanism can comprise a slider mounted in the casing such that it moves parallel, and in particular coaxially, with the main axis, the slider being coupled on the one hand in translation to the push rod and on the other hand by a slot or cam to the pivoting lever.

The pivoting lever can for example have the shape of a fork engaged around the slider in order to be applied against bearing rollers provided on a spindle situated at the end of the locking head, a bearing roller being provided at the centre of the spindle in order to be applied on the slider when the bolt applies a lateral thrust.

BRIEF DESCRIPTION OF THE DRAWINGS.

The following detailed description, given with reference to the appended drawings, illustrates an embodiment given by way of example.

DETAILED DESCRIPTION OF THE INVENTION

Figure 1:
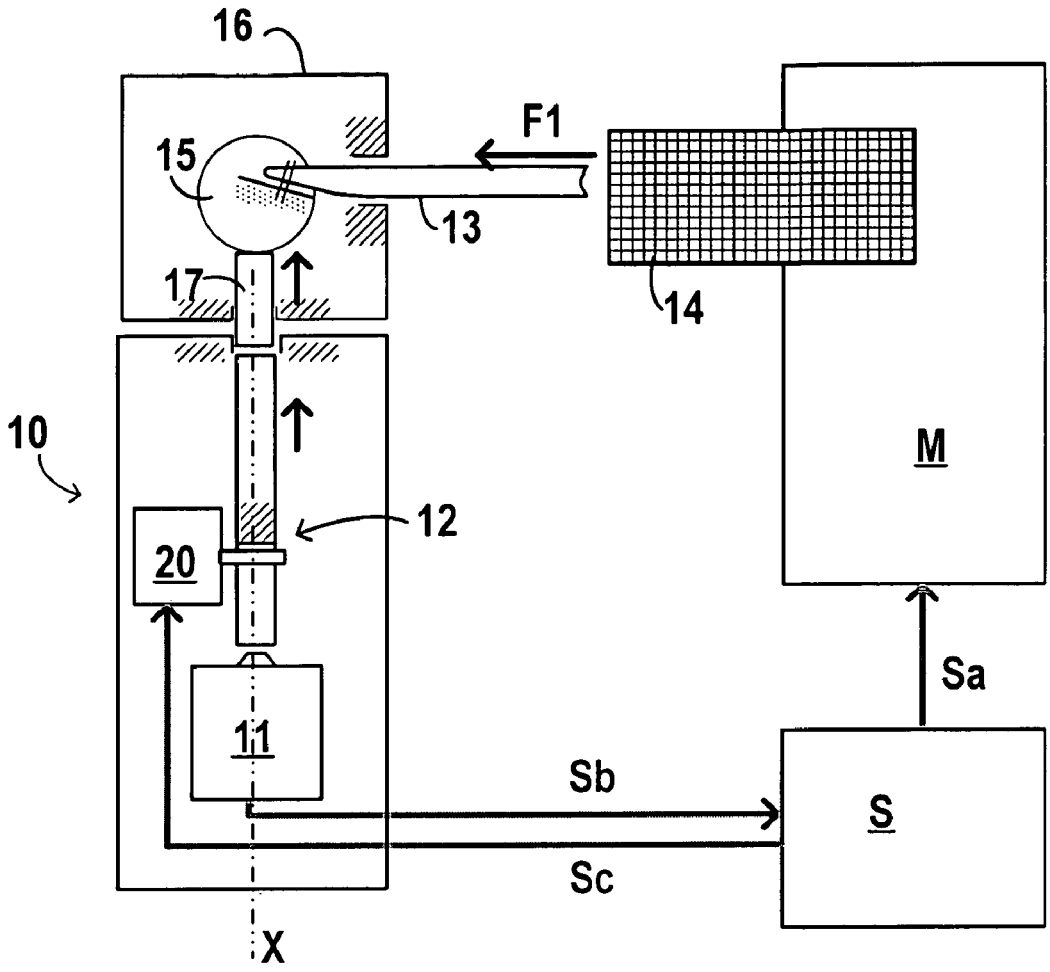
FIG. 1 is a diagrammatic representation of a safety position switch associated with a dangerous machine.

The safety position switch illustrated in FIG. 1 comprises in a casing 10 an electrical switch block 11, in particular a contacts block, and a drive mechanism 12 intended to switch the switch block. The mechanism 12 acts on the block 11 in response to a movement towards or away from the casing (see arrow F1) of an actuator 13. The actuator is provided with specific mechanical and, if necessary, electronic recognition means and it is for example associated with a protective device 14 (grid, obstacle, etc.) associated with a dangerous machine M.

The safety switch has at least one rotating roller 15 or other element provided with shapes appropriate for cooperating with special shapes of the actuator 13 and capable of locking the actuator when the latter is inserted in the casing 10. The roller 15 is housed in a head 16 of the casing 10 of the switch and acts on a push rod 17 included in the head and capable of assuming, depending on whether or not the actuator 13 is coupled with the roller, a rest position (low position in the figures) or a working position (high position in the figures). The head 16 is mounted on the casing in a rotating manner—in order to allow different orientations of the actuator; the mechanism allows this rotation of the head without changing the state of the contacts of the switch block 11.

The drive mechanism 12 interposed between the push rod 17 and the switch block 11 is lockable, that is to say it can be released or locked by a locking device 20. This locking device 20 is an electromagnet, a key operated by an operator, a pneumatic device or any other similar driving device (see for example the documents EP 817 227 and FR 2 751 122). When the device 20 is an electromagnet, it comprises a coil 21 and a core 22, this core being terminated by a locking head 23 which constitutes the locking piece of the mechanism. The locking head 23 locks the mechanism in a single direction, that is to say it prohibits the movement of the push rod from its working position into its rest position, without prohibiting the movement from the rest position to the working position.

A control system S is associated with the machine M in order to control its switching on and off (connection Sa); the system S can also receive the "state of the contacts of the block 11" information (connection Sb) and can also control the switching of the electromagnet 20 (connection Sc).

The drive mechanism 12 comprises, according to the invention, a slider 30 and a pivoting lever 40 forming a system that is deformable under the effect of the movement of the push rod in order to jam the locking head.

The slider 30 is mounted on a support, such as a wall of the casing 10 or a base installed in this casing, in order to move in translation along an axis X' parallel with the main axis X of movement of the push rod 17 (see FIGS. 2 to 9). The casing 10 extends along the direction X, with the disposition of the core 22 of the electromagnet 20 parallel with the axis X of the push rod and, preferably, in alignment with the axis X. The locking head 23 of the core has a spindle 24 that is transverse with respect to X and which carries two lateral rollers 25 and a central roller 26 whose function will be explained below. The slider 30 has a coupling element 31, such as a finger or a fork, coupled to the lower end of the push rod 17, preferably in an annular groove of the push rod in order to allow a rotation of the head 16 of the casing, without changing the state of the contacts of the block 11 nor that of the locking system. The coupling element 31 could also be simply applied against the end of the push rod by a spring. The slider 30 has at least one slot 32 or other form of guidance determining the translation of the slider, and cooperating with two fixed guidance spindles 33, 34. Finally the slider 30 has a control pin 35 slightly offset laterally with respect to the axis X'. A lateral face 36 of the slider 30 can be acted upon by the central roller 26 of the locking head 23, as will be described below.

The pivoting lever 40 is associated with the locking head 23 of the locking core 22 which is situated towards the push rod 17. The pivoting lever 40 has the function of locking the core 22 in its high position (working position) when the actuator 13 is inserted in the head 16 of the casing 10. The lever 40 is mounted such that it pivots about an axis Y perpendicular to the main axis X and has for this purpose a journal 41 mounted on the fixed spindle 33, which therefore serves on the one hand as a pivot and on the other hand as a guidance axis for the slot 32. The axis Y is situated, in the direction X, substantially between the push rod 17 and the locking head 23. The lever 40 also has an incurved slider 42 for cooperating with the pin 35. The purpose of the specific shape of the slot is to cause the lever 40 to pivot in an appropriate manner about the spindle 33.

The lever 40 forms a locking arm 43 which is terminated at its free end buy a jamming element 44 intended to apply a transverse pressure on the lateral rollers 25. The lever 40 forms a stop keeper in which the locking head 23 can become lodged. On the part of the lever situated towards the head 23 there is provided a convex surface or slope 46 against which the head 23 is applied when the locking device 20 is in its unlocked state.

Figure 2:
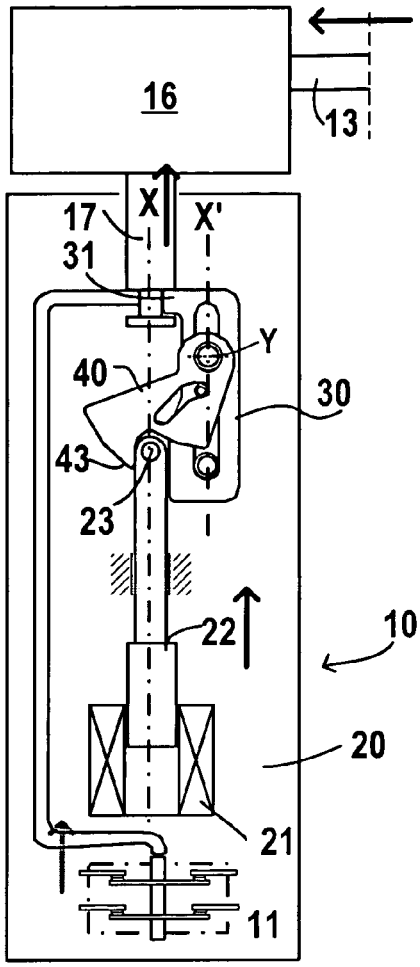
FIG. 2 illustrates a first embodiment of the safety switch according to the invention in the locked state.
Figure 3:
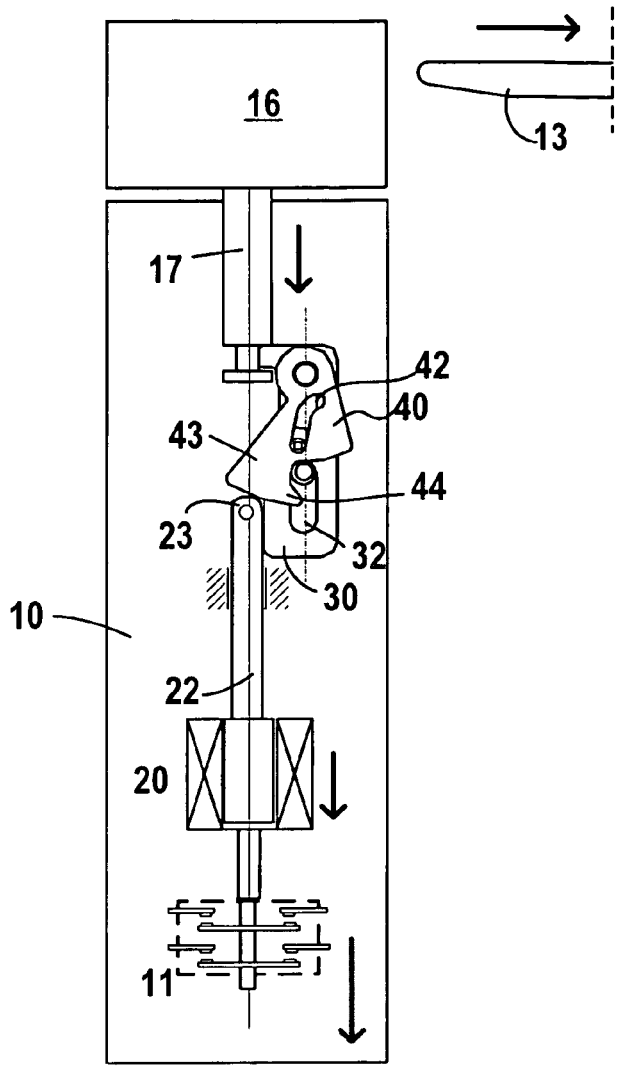
FIG. 3 illustrates a second embodiment in the unlocked state.

FIG. 2 illustrates an embodiment in which the contacts block 11 is actuated directly by the slider 30, the contacts then reflecting the state of the actuator. The block 11 can also be actuated directly by the push rod 17. FIG. 3 shows an embodiment in which the contacts block 11 is actuated from the core 22, the contacts then reflecting the state of the electromagnet.

The functioning of the switch will now be explained with reference to FIGS. 4 to 7.

Figure 4:
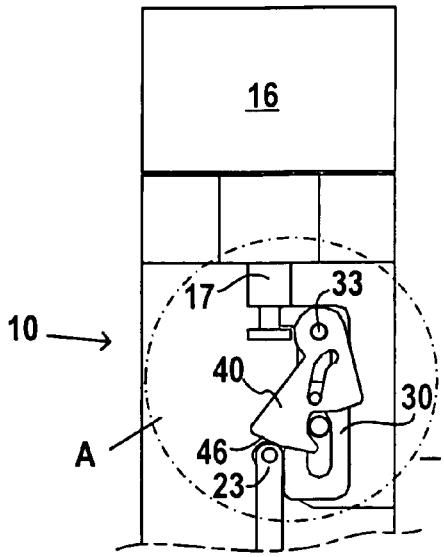
FIGS. 4 and 5 show the drive mechanism in the unlocked state and in the locked state respectively.
Figure 6:
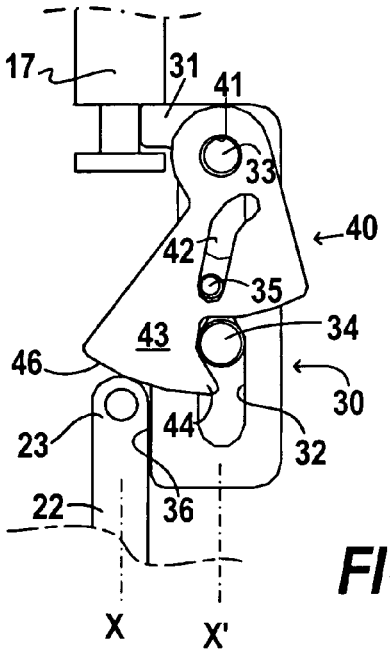
FIGS. 6 and 7 are enlarged views of the detail A of FIGS. 4 and 5.

In the case illustrated in FIGS. 4 and 6, the actuator 13 is withdrawn from the head 16 of the switch, such that the push rod 17 is placed in the low position. The slider 30 coupled to the push rod is also put in the low position and, via the pin 35, pushes the lever 40 in the anticlockwise direction into the unlocked position. This means that the core 22 of the electromagnet, shown in the low position in FIGS. 4 and 6, is in an unlocked state. Depending on the case, this state corresponds to the energized case or non-energized case of the coil 21 of the electromagnet 20 (in the latter case, the core 22 is pushed upwards by a spring and remains in equilibrium against the lower surface 46 of the lever 40).

Figure 5:
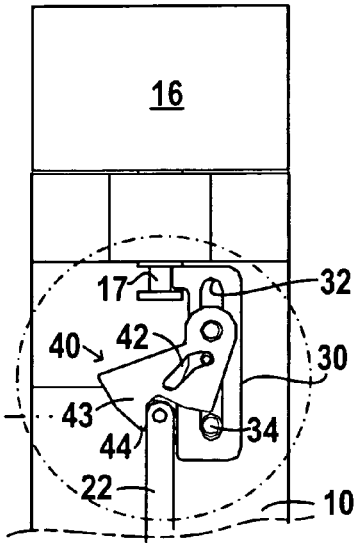
Figure 7:
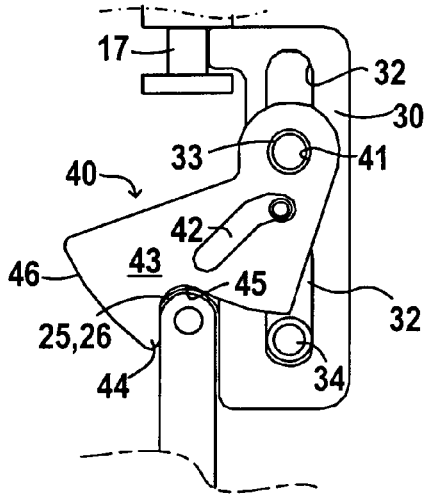

In order to change to the state illustrated in FIGS. 5 and 7, the actuator is engaged in the head 16 of the switch, and the push rod 17 rises whilst driving the slider 30. By means of the pin 35, the slider 30 forces the lever 40 to pivot in the clockwise direction until it reaches the position shown in FIGS. 5 and 7. If the coil 21 is (or remains) energized, the core 22 remains in the low position. If the coil 21 is (or remains) non-energized, the lower surface 46 of the lever slides over the rollers 25 of the core 22 and then the rollers 25 become engaged in the space located between the jamming elements 44 and the lateral face 36 of the slider 30 and remain lodged against the top stop in the keeper 45 formed by this space. Any force applied to the actuator to extract it from the head 16 of the switch brings about a jamming effect of the elements 44 on the locking head 23, which becomes greater as the extraction force becomes stronger; the force cannot damage the electromagnet since the roller 26 carried by the spindle 24 of the locking head 23 is applied against the lateral face 36 of the slider 30. The resultant force is thus taken up by the guidance of the core and, via the spindles 33, 34, by the casing.

It is appropriate to observe that the lever arms "pivot 33-pin 35" and "pivot 33-locking elements 44" are mutually determined in such a way as to greatly reduce the force imparted to the core as a result of action by the actuator in the direction of extraction and thus makes it possible to unlock the locking device whilst the lever 40 is clamped on the locking head 23.

The shown switch allows a rotation of the head 16 with respect to the rest of the casing without changing the state of the contacts of the switch block 11 nor the state of the drive mechanism nor that of the locking device.

Figure 8:
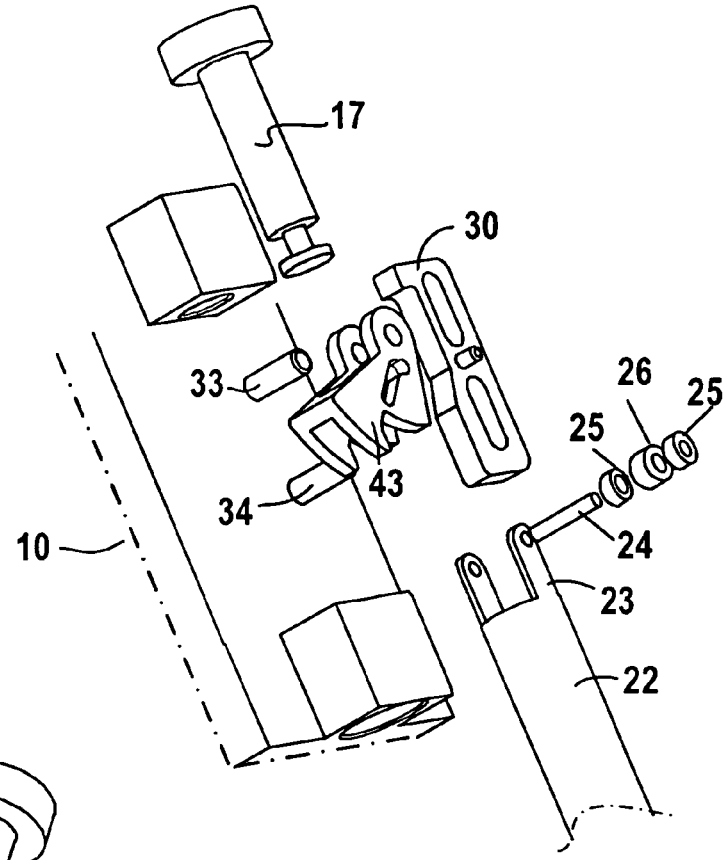
FIGS. 8 and 9 are two exploded views in perspective, from the left and from the right respectively, of a part of the safety switch according to the invention.
Figure 9:
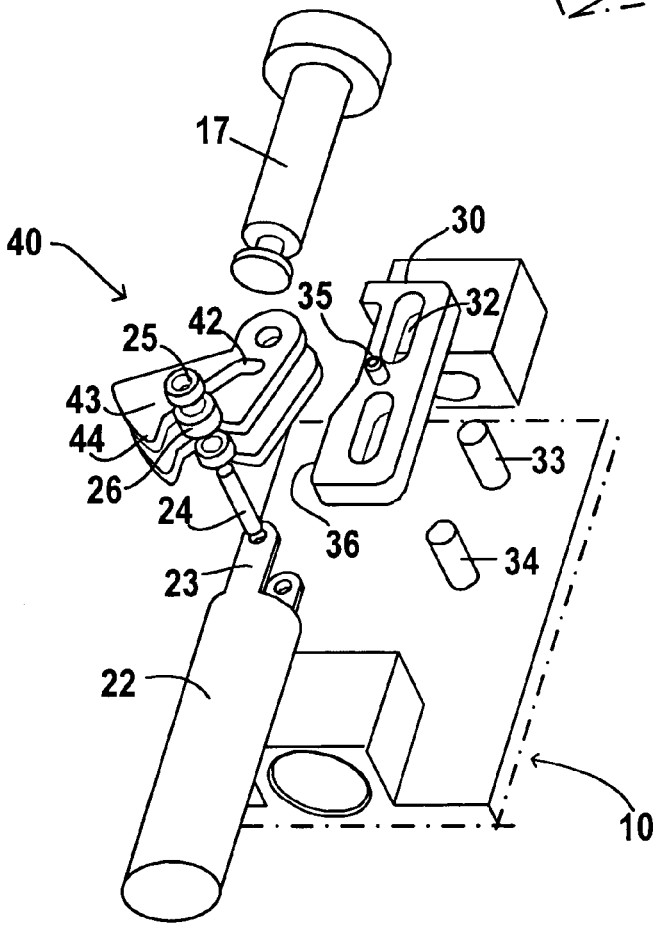

FIGS. 8 and 9 show, in an exploded manner, the component parts of the drive mechanism 12 and illustrate in particular the guidances provided in the head 16 for the push rod 17 and in the main part of the casing 10 for the core. In particular, there can be seen the rollers 25 and 26 mounted on the spindle 24 which is associated with the locking head 23 and the embodiment of the pivoting lever 40 as a fork engaged around the slider 30, each branch of the fork acting on a roller 25 disposed on the spindle 24.

What is claimed is:

1. Safety position switch comprising, in a casing:

a push rod which responds to movement of an actuator connected to a device to be made safe, in such a way as to become displaced along a main axis in order to assume a rest position and a working position, an electrical device switchable according to the position of the push rod, by means of a lockable transmission mechanism actuated by the push rod, a device (20) for locking the transmission mechanism, said locking device having a head for locking the transmission mechanism, capable of assuming a locked position and an unlocked position, characterized in that:

the transmission mechanism comprises a pivoting lever capable of assuming a locked position and an unlocked position, the pivoting lever has a force applied to the lever from the push rod such that a movement of translation of the push rod generates a rotation of the lever, the pivoting lever is provided with a jamming element that is applicable, in the locked position of the lever and transversely with respect to the main axis, against the locking head.

2. Position switch according to claim 1, characterized in that the pivoting lever is mounted and arranged such that the force applied to the locking head is low in comparison with the force undergone by the actuator, in a ratio allowing a movement of the locking head whilst the actuator is under load and following a control to unlock the locking device.

3. Position switch according to claim 1, characterized in that the locking head moves in translation along the main axis and the pivoting lever forms a stop keeper for an end of the locking head in the locked position and a bearing slope adjacent to the keeper, the end of the locking head being applied against the slope in the unlocked position.

4. Position switch according to claim 1, characterized in that the lever is mounted such that the lever pivots about an axis perpendicular to the main axis and in that the transmission mechanism comprises a slider mounted in the casing such that the slider moves parallel with the main axis, the slider being coupled in translation to the push rod and by a slot or cam to the pivoting lever.

5. Position switch according to claim 4, characterized in that the pivoting lever is mounted on a fixed pivot forming a guidance axis for the slider.

6. Position switch according to claim 4, characterized in that the pivoting lever has the shape of a fork engaged around the slider in order to be applied against bearing rollers provided on a spindle situated at the end of the locking head, one bearing roller of the bearing rollers being provided at a centre of the spindle in order to be applied against the slider when the bolt applies a lateral thrust.

7. Safety position switch comprising, in a casing:

a push rod which responds to the movement of an actuator in such a way as to become displaced along a main axis in order to assume a rest position and a working position depending on a state of a device to be made safe, an electrical device switchable according to the position of the push rod, by means of a lockable transmission mechanism acted upon by the push rod, a device for locking the transmission mechanism, said locking device having a locking head which faces the push rod and is movable along an axis parallel with or merged with the main axis, characterized in that:

the transmission mechanism comprises a jamming system that is deformable under effect of the movement of the push rod, said jamming system being provided with a stop for the locking head in the direction of the main axis and with a jamming element applying on the locking head a force that is transverse with respect to the main axis when the actuator tends to be withdrawn from the switch casing.

8. A safety position switch comprising:

an actuator;

a push rod displaceable along a main axis between a rest position and a working position by the actuator;

an electrical device switchable according to the position of the push rod by a lockable transmission mechanism actuated by the push rod; and a locking device having a head configured to lock the transmission mechanism, the head having a locked position and an unlocked position, wherein:

the transmission mechanism comprises a pivoting lever having a locked position and an unlocked position, the push rod is configured to apply a force to the pivoting lever such that a movement of the push rod along the main axis generates a rotation of the pivoting lever, and the pivoting lever has a jamming element that is applicable, in the locked position of the pivoting lever and transversely with respect to the main axis, against the head.

9. The safety position switch according to claim 8, wherein the pivoting lever is mounted and arranged such that the force applied to the head is low in comparison with the force undergone by the actuator, in a ratio allowing a movement of the head whilst the actuator is under load and following a control to unlock the locking device.

10. The safety position switch according to claim 8, wherein the head moves in translation along the main axis and the pivoting lever forms a stop keeper for an end of the head in the locked position and a bearing slope adjacent to the stop keeper, the end of the head being biased against the slope in the unlocked position.

11. The safety position switch according to claim 8, wherein the pivoting lever is mounted to pivot about an axis perpendicular to the main axis and wherein the transmission mechanism comprises a slider mounted in a casing such that the slider is configured to move parallel with the main axis, the slider being coupled in translation to the push rod and by a slot or cam to the pivoting lever.

12. The safety position switch according to claim 11, wherein the slider is configured to move coaxially with the main axis.

13. The safety position switch according to claim 11, wherein the pivoting lever is mounted on a fixed pivot forming a guidance axis for the slider.

14. The safety position switch according to claim 11, wherein the pivoting lever has a shape of a fork engaged around the slider in order to be applied against bearing rollers provided on a spindle situated at an end of the head, one bearing roller of the bearing rollers being provided at a centre of the spindle in order to be applied against the slider when the bolt applies a lateral thrust.

15. A safety position switch comprising:

a push rod configured to respond to movement of an actuator, the push rod being configured to be displaceable along a main axis between a rest position and a working position depending on a state of a device to be made safe;

an electrical device switchable according to the position of the push rod by a lockable transmission mechanism acted upon by the push rod; and a locking device configured to lock the transmission mechanism, said locking device having a locking head that faces the push rod and is movable along an axis parallel with or merged with the main axis, wherein the transmission mechanism comprises a jamming system that is deformable under effect of the movement of the push rod, said jamming system being provided with a stop for the locking head in the direction of the main axis and with a jamming element configured to apply on the locking head a force that is transverse with respect to the main axis when the actuator tends to be withdrawn from the switch casing.

* * * * *